US007387576B2

(12) United States Patent
Agnew

(10) Patent No.: US 7,387,576 B2
(45) Date of Patent: Jun. 17, 2008

(54) GOLF CLUB

(76) Inventor: John Edward James Agnew, No. 111 Malcolm Spence Street, Olympia, 9000 Windhoek (NA)

( * ) Notice: Subject to any disclaimer, the term of this patent is extended or adjusted under 35 U.S.C. 154(b) by 40 days.

(21) Appl. No.: 10/544,966

(22) PCT Filed: Feb. 5, 2004

(86) PCT No.: PCT/IB2004/000278

§ 371 (c)(1),
(2), (4) Date: Jun. 26, 2006

(87) PCT Pub. No.: WO2004/071585

PCT Pub. Date: Aug. 26, 2004

(65) Prior Publication Data

US 2007/0010343 A1 Jan. 11, 2007

(30) Foreign Application Priority Data

Feb. 11, 2003 (ZA) ..... 2003/1142

(51) Int. Cl.
*A63B 69/36* (2006.01)

(52) U.S. Cl. ..... 473/240; 473/241; 473/172

(58) Field of Classification Search ..... 473/219–256, 473/172; D21/746
See application file for complete search history.

(56) References Cited

U.S. PATENT DOCUMENTS 1,327,171 A * 1/1920 Guy ..... 473/240
2,822,614 A * 2/1958 Susinno ..... 33/263
2,923,552 A * 2/1960 Sundberg ..... 473/238
3,273,891 A * 9/1966 Grim, Jr. ..... 473/240
3,319,962 A * 5/1967 Summers ..... 473/251
3,403,912 A * 10/1968 Maroun ..... 473/240
3,507,500 A * 4/1970 Scott ..... 473/240
4,413,824 A * 11/1983 King et al. ..... 473/240
4,601,472 A * 7/1986 O'Flanagan ..... 473/240
4,934,706 A * 6/1990 Marshall ..... 473/241
4,962,932 A * 10/1990 Anderson ..... 473/336
4,988,107 A * 1/1991 Sasse ..... 473/254
5,052,690 A * 10/1991 Sharp ..... 473/240
5,209,470 A * 5/1993 Cimaroli et al. ..... 473/241
5,640,777 A 6/1997 Densberger et al.
5,857,920 A 1/1999 Hong
5,893,804 A * 4/1999 Pan ..... 473/240
5,954,593 A * 9/1999 Benoit et al. ..... 473/240
6,213,887 B1 * 4/2001 Carney ..... 473/183

* cited by examiner

*Primary Examiner*—Sebastiano Passaniti
(74) *Attorney, Agent, or Firm*—Frommer Lawrence & Haug LLP; William S. Frommer

(57) ABSTRACT

The invention provides a golf club, generally indicated by reference numeral (10). The golf club (10) includes a shaft (14) and club head (12) connected to the shaft (14). The golf club (10) further includes means defining a reflective surface (16) positioned so that when a user of the golf club (10) addresses a ball an intended target towards which a said ball is to be struck is visible in the reflective surface (16). The golf club also includes level indicators (40, 50), in the form of spirit levels, mounted on the head (12) to permit a user to determine when the head (12) is in a desired horizontal orientation when addressing a ball with the golf club (10). The level indicators (40, 50) is positioned to form an alignment aid, the alignment aid including parallel markings (38) on the reflective surface (16) in register with corresponding ends of the spirit levels (40,50).

9 Claims, 3 Drawing Sheets

GOLF CLUB

THIS INVENTION relates to a golf club. It also relates to a golf practise aid.

In playing golf, golf players are not concerned only with applying the correct weight of stroke to a golf ball, but among others, also with the intended initial direction in which a golf ball travels after it has been struck. The initial direction in which a golf ball travels is determined at least in part by the alignment of the swing path of the club head relative to the golf ball and the intended target or direction. Golfers find it generally difficult to achieve this alignment when addressing the golf ball, and to maintain this alignment during the execution of the stroke. The applicant believes that an accurate alignment may improve the accuracy with which a ball can be struck and the repeatability of a player's swing or stroke.

According to the invention, there is provided a golf club which includes, a shaft;

a club head connected to the shaft and defining a front or ball striking face; and means defining a reflective surface positioned on the golf club so that when a user of the golf club addresses a ball an intended target towards which a said ball is to be struck is visible in the reflective surface.

Preferably, the golf club is in the form of a putter.

The reflective surface may be provided on the club head.

The reflective surface is typically inclined relative to a longitudinal axis of the shaft. The reflective surface may lie in a plane which is inclined at an angle of 45 degrees relative to the shaft.

The golf club may include at least one alignment aid positioned on the golf club. In this regard a pair of parallel spaced apart markings may be provided on the reflective surface, the markings extending perpendicular to the front face and being equally spaced on opposite sides of the point of the face with which a ball should ideally be struck.

The front ball striking-face typically has a height which is less than the diameter of a golf ball. The height of the front face may be about 2.5 cm. The head may have a width of about 5 cm. The head may have a length of about 10 cm.

The front face of the club head may also curve transitionally into a sole of the club head, to form a rounded lower front edge for the golf club.

The golf club may further include at least one level indicator mounted on the head to permit a user to determine when the head is in a desired horizontal orientation when addressing a ball with the golf club. The club head typically includes two level indicators positioned at spaced apart positions on the club head. Each one of the level indicators may be in the form of a spirit level and each spirit level may be positioned to form an alignment aid, the alignment aid including parallel markings on the reflective surface in register with corresponding ends of the spirit levels.

According to another aspect of the invention, there is provided a golf practise aid which includes a golf club of the type described above; and at least one target.

The target may be in the form of an open mouthed receptacle, the mouth of which has a diameter greater than the diameter of a golf ball.

The invention will now be described, by way of example, with reference to the accompanying diagrammatic drawings.

Figure 1:
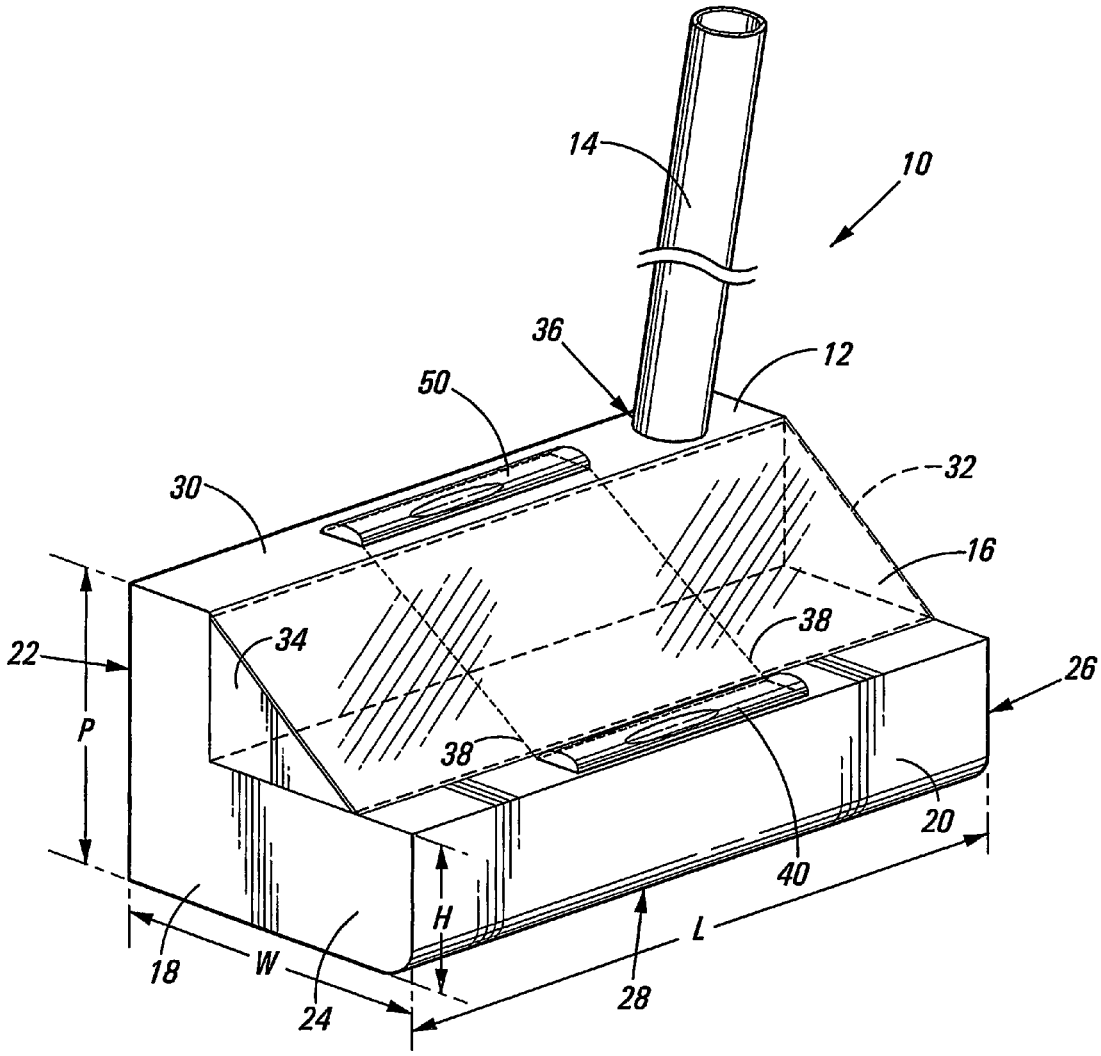
FIG. 1 shows a three-dimensional view of part of a golf club in accordance with the invention.

In the drawings, reference numeral 10 refers generally to a golf club, in the form of a putter 10, in accordance with the invention. The putter 10 includes a head 12, a shaft 14 and a reflective surface 16.

Figure 2:
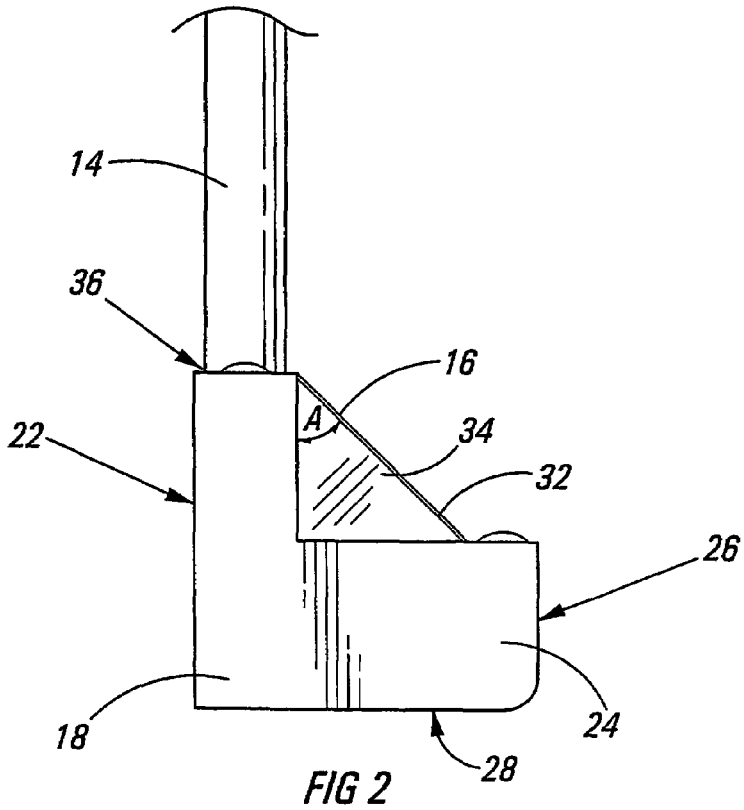
FIG. 2 shows a view from one end of the part of the golf club in FIG. 1.

The head 12 includes a body 18 which is generally L-shaped when viewed from an end thereof (see FIG. 2). The body 18 has a front or ball-striking face 20, a rear face 22, end faces 24, 26, a sole 28 and a top 30.

The reflective surface 16 is formed by a mirror 32 mounted on a support 34 which in turn is mounted on the body 18 such that the mirror 32 is inclined upwardly rearwardly from a position adjacent an upper edge of the front face 20. In this embodiment, the reflective surface lies in a plane which is inclined at an angle A of 45 degrees relative to the shaft (see FIG. 2).

A lower end portion of the shaft 14 is secured, typically adhesively, in a bore or socket 36 which opens out of the top 30 such that the shaft 14 extends operatively upwardly from the head 12.

The putter 10 further includes a pair of spirit levels/level indicators 40, 50. Both of the spirit levels 40, 50 are centrally disposed and recessed into the body 18. More particularly, the spirit level 40 is positioned adjacent to a lower edge of the mirror 32 and the spirit level 50 is positioned on the top 30. The spirit levels 40, 50 are longitudinally aligned in order to form an alignment aid as described in more detail herebelow.

The putter 10 further includes an alignment aid in the form of a pair of parallel markings 38 provided on the reflective surface 16. The markings 38 extend perpendicularly to the front face 20 and are positioned equidistantly on opposite sides of the point on the putter with which a ball-should ideally be struck sometime referred to as sweet spot or the centre of percussion. Each of the spirit levels 40, 50, typically has a length of about 4 cm and the markings 38 are spaced apart at a distance K so that the markings 38 are in register with corresponding ends of the spirit levels 40, 50.

In the embodiment shown, the putter 10 is intended for use by a right-handed player and the shaft 14 is inclined in the direction of the end face 26, which end forms the heel of the head 12. Naturally, however, left handed versions of the putter are also envisaged.

The front face 20 has a height H which is typically smaller than the diameter of a golf ball. The height H will typically be of the order of 2.5 cm.

The head 12 typically has a length L of about 10 cm, a height P of about 5 cm and a width W of about 5 cm. Naturally, the dimensions of the head can be varied to suit a particular preference.

The intersection between the front face 20 and the sole 18 is curved to reduce the risk that the putter 10 will catch on a surface on which a ball is being putted. The front face 20 is parallel with the shaft 14 and perpendicular to the sole 28 so that it lies in a vertical plane at address.

Figure 4:
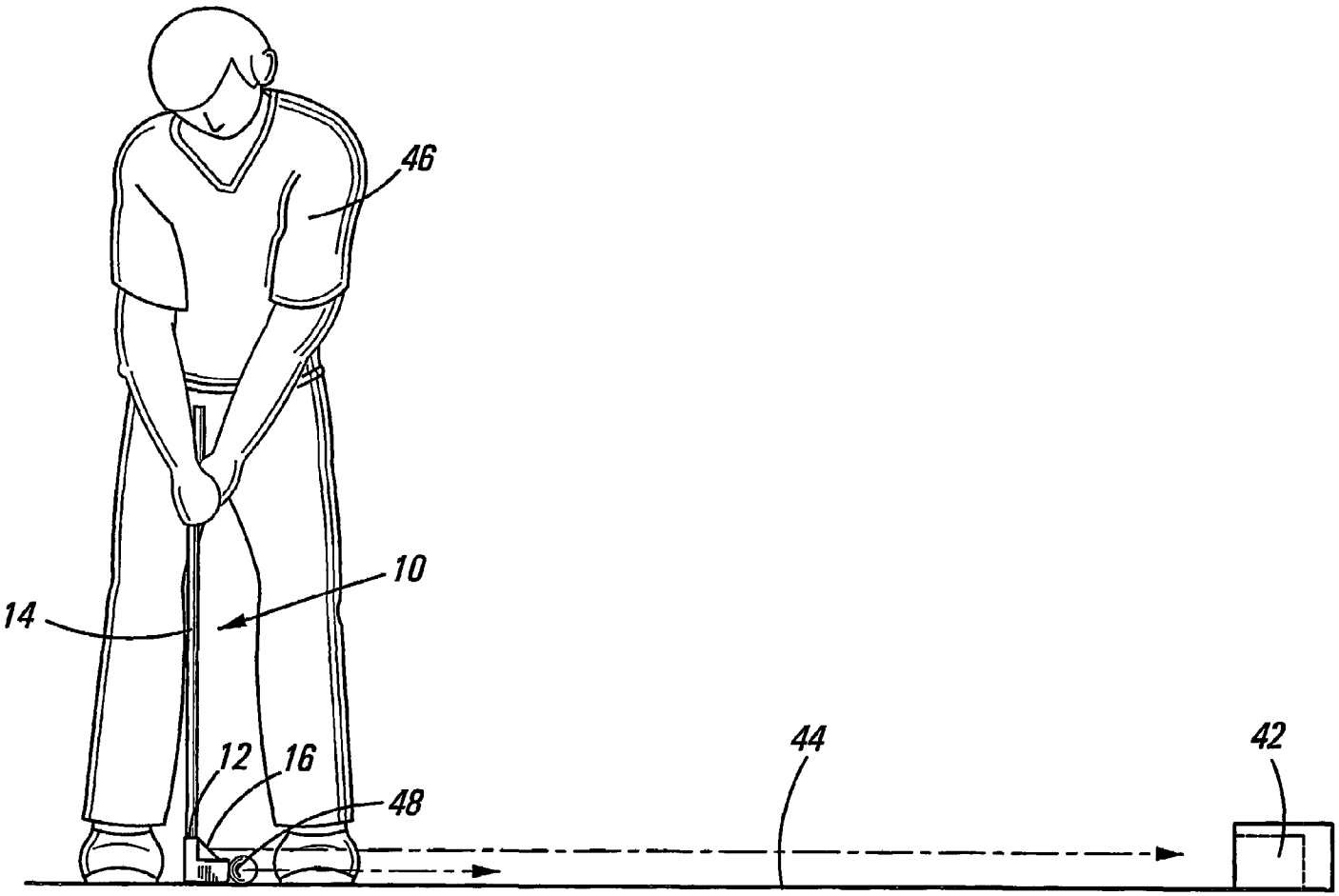
FIG. 4 shows the golf club in use.

As can best be seen in FIG. 4 of the drawings, in use, a target 42 is positioned on a surface 44. The surface 44 can be a carpet, a practise putting green, or the like. When the surface 44 is indoors, e.g. a carpet, then the target 42 is typically in the form of an open mouthed receptacle which is positioned such that the mouth faces along the surface 44.

When the surface 44 is the surface of a practice putting green, the target could be a hole in the ground. In order to render the target more visible, a flag stick or the like (not shown), could protrude from the hole.

Figure 3:
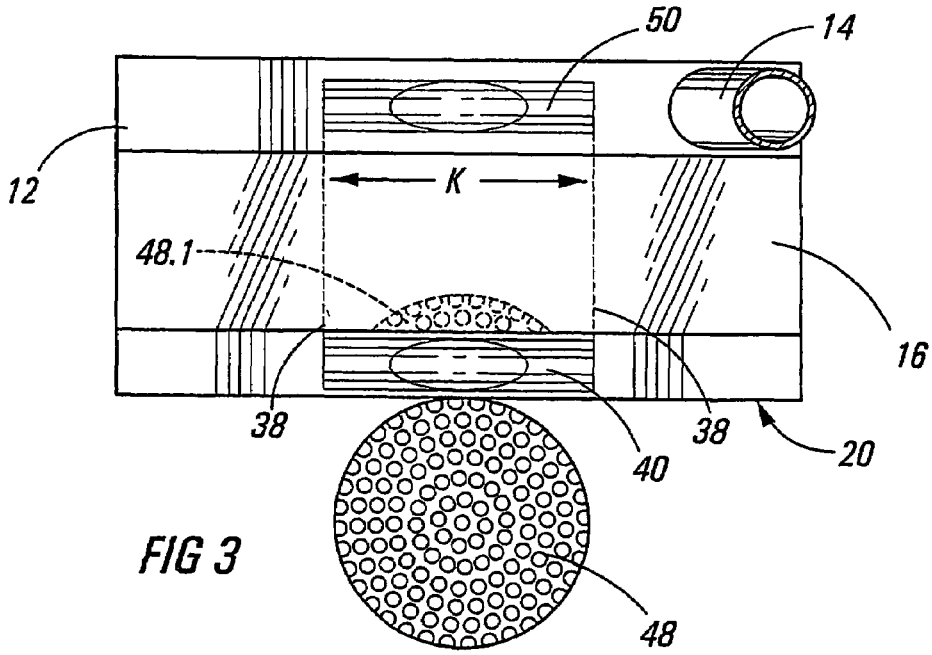
FIG. 3 shows a plan view of the part of the golf club of FIG. 1 and a golf ball, the golf club being in a typical position when a user addresses the golf ball.

A player 46 addresses a ball 48 with the putter 10, i.e. the player positions the head of the putter 10 immediately behind the ball 48 (see FIG. 3). The player then adjusts the putter 10 so that the spirit levels are aligned with the diameter of the ball 38 and an intended line of travel of the ball 48. In this position, the ball 48 should be positioned approximately midway between the markings 38. In addition, the putter is manipulated until the spirit levels 40, 50 indicate that the head 12 is level. The target 42 should then be visible to the player in the reflective surface 16 above a reflection 48.1 of an upper portion of the ball 48 which protrudes above the upper edge of the front face 20. The player then aligns the reflected target image with the reflected image of the upper part of the ball. This ensures that the front face 20 is perpendicular to the intended path of travel of the ball. The player then executes a stroke while attempting to maintain the head of the putter generally horizontal as indicated by the spirit levels 40, 50.

The reflected image of the ball 48 in the relative surface 16, is an image of the ball 48 as viewed from behind the ball in the direction towards the intended target i.e. effectively the player views the ball from behind inline with and towards the target, contrary to the case of a player using a standard putter, in which case the golf ball is viewed generally perpendicular to the intended travelling path of the golf ball. The Inventor believes that this facilitates proper alignment.

Characteristic of this embodiment of the invention as described, i.e. the putter 10, is that if the putter 10 is placed upright on a level surface, the putter 10 is freestanding. In this freestanding position on a level surface, the spirit levels 40, 50 should indicate a level condition. This can be used as a test for the accuracy and condition of the spirit levels 40, 50.

Naturally, the length of the shaft may vary so that the invention is also applicable to putters having longer shafts such as those referred to as belly putters and broom handle putters.

Further, a putter of the type described, can embody the invention and still fall within the parameters as laid down for a putter by The Royal and Ancient Golf Club of St. Andrews and the United States Golf Association.

Although the putter can be used to play golf the Inventor believes that it will find application particularly as a practice aid. In this regard the putter may be supplied with a target 42 towards which a ball can be putted in the manner described above.

The Inventor believes that by making use of a putter 10 in accordance with the invention, the correct stroke and swing path can be achieved and, with regular practise, the player's putting technique and muscle memory can be improved resulting in a substantial improvement in his putting.

The invention claimed is:

1. A golf club which includes, a shaft;

a club head connected to the shaft and defining a front or ball striking face;

an alignment aid which includes two level indicators in the form of spirit levels positioned on the club head at positions in parallel alignment to the front face to permit a user to determine when the head is in a desired horizontal orientation when addressing a ball with the golf club and to serve as an alignment aid for aligning the club head, a ball and an intended line of travel; and means defining a reflective surface positioned on the golf club so that when a user of the golf club addresses a ball an intended target towards which a said ball is to be struck is visible within the reflective surface, the alignment aid further including a pair of parallel spaced apart markings provided on the reflective surface, the markings extending perpendicular to the front face and being equally spaced on opposite sides of the point of the face with which a ball should ideally be struck in register with corresponding ends of the spirit levels.

2. A golf club as claimed in claim 1, in which the golf club is in the form of a putter.

3. A golf club as claimed in claim 1, in which the reflective surface is provided on the club head.

4. A golf club as claimed in claim 3, in which the reflective surface is inclined relative to a longitudinal axis of the shaft.

5. A golf club as claimed in claim 4, in which the reflective surface lies in a plane which is inclined at an angle of 45 degrees relative to the shaft.

6. A golf club as claimed in claim 1, in which the front ball striking-face has a height which is less than the diameter of a golf ball.

7. A golf club as claimed in claim 1, in which the front face of the club head curves transitionally into a sole of the club head, to form a rounded lower front edge for the golf club.

8. A golf practice aid which includes a golf club as claimed in claim 1, and at least one target.

9. A practice aid as claimed in claim 8, in which the target is in the form of an open mouthed receptacle, the mouth of which has a diameter greater than the diameter of a golf ball.

* * * * *